US006481252B2

(12) United States Patent
Calle et al.

(10) Patent No.: US 6,481,252 B2
(45) Date of Patent: Nov. 19, 2002

(54) SECURITY LOCK

(76) Inventors: Franco D Calle, 14504 Briar Forest Dr., #925, Houston, TX (US) 77077; Ron R. Daniels, 2714 Greg Way La., Missouri City, TX (US) 77459; Sheila M. Daniels, 2714 Greg Way La., Missouri City, TX (US) 77459

( * ) Notice: Subject to any disclaimer, the term of this patent is extended or adjusted under 35 U.S.C. 154(b) by 0 days.

(21) Appl. No.: 09/745,148

(22) Filed: Dec. 20, 2000

(65) Prior Publication Data

US 2002/0007655 A1 Jan. 24, 2002

Related U.S. Application Data

(60) Provisional application No. 60/172,871, filed on Dec. 20, 1999.

(51) Int. Cl.[7] ..... E05B 65/06

(52) U.S. Cl. ..... 70/94; 70/101; 70/139; 70/DIG. 64; 292/259 R

(58) Field of Search ..... 70/101, DIG. 64, 70/94, 124, 135, 136, 139, DIG. 65, DIG. 66; 292/259 R, 298

(56) References Cited

U.S. PATENT DOCUMENTS

| | | | | | |
|---|---|---|---|---|---|
| 446,789 | A | * | 2/1891 | Reed | 70/120 |
| 1,501,640 | A | * | 7/1924 | Anderson | 70/120 |
| 1,700,129 | A | * | 1/1929 | Hausmann | 70/120 |
| 2,421,275 | A | * | 5/1947 | Lopez | 292/259 R |
| 2,920,474 | A | * | 1/1960 | Johns | 70/120 |
| 3,971,238 | A | * | 7/1976 | Walker | 70/135 |
| 3,975,934 | A | * | 8/1976 | Babai et al. | 70/120 |
| 4,962,652 | A | * | 10/1990 | Schneider | 70/120 X |
| 5,193,370 | A | * | 3/1993 | Norden | 70/120 |
| 5,778,708 | A | * | 7/1998 | Crosby et al. | 70/120 X |
| 5,791,173 | A | * | 8/1998 | Montes | 70/101 |
| 6,030,019 | A | * | 2/2000 | Stiltner et al. | 70/120 X |

FOREIGN PATENT DOCUMENTS

| | | | | |
|---|---|---|---|---|
| DE | 329455 | * | 11/1920 | 292/259 R |
| FR | 6802 | * | 1/1907 | 292/259 R |
| GB | 841 | * | 1/1915 | 70/DIG. 64 |

* cited by examiner

*Primary Examiner*—Lloyd A. Gall
(74) *Attorney, Agent, or Firm*—The Matthews Firm

(57) ABSTRACT

A security locking system that includes a cross bar pivotally connected at one end in a manner to pivot in two planes, a locking brace connected to a door frame at an opposite point from the point of the pivoting connection of the cross bar in a locking brace which includes an actuating mechanism which rotates around the locking bar and pulls the locking bar into a U-shaped sleeve. In an alternative embodiment, a segmented cross-bar is located totally within the door and is lengthened or shortened by rotation of a key on the outside of the door to enter or exit a pair of receptacles in the door frames to lock the door, or to open the door, respectively.

1 Claim, 10 Drawing Sheets

SECURITY LOCK

RELATED APPLICATION

This application claims priority from United States Provisional Patent Application Ser. No. 60/172,871, filed on Dec. 20, 1999, for "New Millennium Security Lock."

TECHNICAL FIELD

The present invention relates to door locking equipment and more particularly to a door locking mechanism included between first and second parallel door frames in which the door is situated, a cross bar brace which pivots and rotates from a mounting point located on the interior surface of the first door frame, a lock mechanism including a pivoting bar, for example, steel or hard plastic having a holding mechanism which rotates and slides into a U-shaped sleeve entrapping the steel bar in a first length-wise cross position which when unlocked allows the steel bar to rotate so the door, situated between first and second parallel door frames, can be opened from the outside.

In an alternative embodiment of the invention, a steel or hard plastic bar is situated completely across the interior width of a door. A Z-shaped mechanism is located between the two ends of the bar and is axially connected to a locking mechanism located on the exterior surface of the door. In the locked position, as the key in the locking mechanism is rotated, the Z-shaped mechanism causes the bar to extend in length and the two ends of the bar to be further apart. When so extended, the two bar ends extend into two receptacles, respectively, located in two parallel door frames in which the door is situated.

BACKGROUND OF INVENTION

It is often easy for thieves and robbers to break through a conventional door lock mechanism because the bolt of the door lock extends only an inch or so into a frame portion of the door. It is desirable, therefore, to have a locking system which includes a cross bar which is mounted across the width of the door and is attached to both sides of the frame of the door. Although the distance between said mounting point and said locking brace equates essentially with the width of the door, and despite such cross bars being desirable and difficult to defeat, it has been considered very nearly impossible to have such a cross bar in use across the interior surface of the door, and especially when the home resident is not at home. It would be desirable, therefore, to have a cross bar system that includes a mechanism which allows the cross bar to be lifted from the bracket holding the cross bar via a lock mechanism so that the user can turn the key from outside the door, gain entry and remove the cross bar simultaneously.

SUMMARY OF INVENTION

It is thus an object of the invention to provide a new security lock that includes a cross bar brace which pivots and rotates from a mounting point on the interior side of a first door frame, a locking brace provided on the interior side of the door and a locking mechanism including a pivoting bar holding mechanism which rotates and slides into a U-shaped sleeve entrapping the steel bar in a length wise cross position in a first position and when unlocked pushes the steel bar upward to a position where it is free to rotate along or about an axis parallel to the rotation of the door so that the door can be opened from the exterior side of the door. The distance between the mounting point and the locking brace being the location brace being essentially slightly wider than the door.

In an alternative embodiment of the present invention, a steel rod, or a different rod fabricated from a hard material, for example from nylon, has a length which when extended in accordance with the invention is longer than the width of the door and is intended to extend between a pair of receptacle holes fabricated into the two parallel door frames in which the door is to be situated. In this embodiment, a mechanism is located between the two ends of the rod and is caused to be rotated by the rotation of a key used in a locking mechanism in the exterior surface of the door. The rotating mechanism located between the two ends of the steel bar is preferably Z-shaped when the arm is in the open position and takes on a different shape, for example, being merely a connection member bearing an angle of approximately 45 degrees between the two interior ends of the steel bar in the closed position. The entire steel arm and the rotatable center member are hidden from view when viewing the inside surface of the door and also hidden from view from the exterior surface of the door other than for the mechanism within which the key is turned. In the operation of this embodiment, the door will always be locked from the outside. Whenever it is decided to unlock the door from the outside, the key is inserted into the locking mechanism on the exterior surface of the door and is rotated to cause the steel bar to be shortened and to pull out of the two receptacle holes in the door frames, respectively, thus allowing the door to be unlocked and the resident to open the door and thereby gain entry into the house. Parallel the two embodiments described above has some commonality in that neither door can be opened from the interior of the house and can only be locked or unlocked from the keying mechanism located on the exterior surface of the door.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
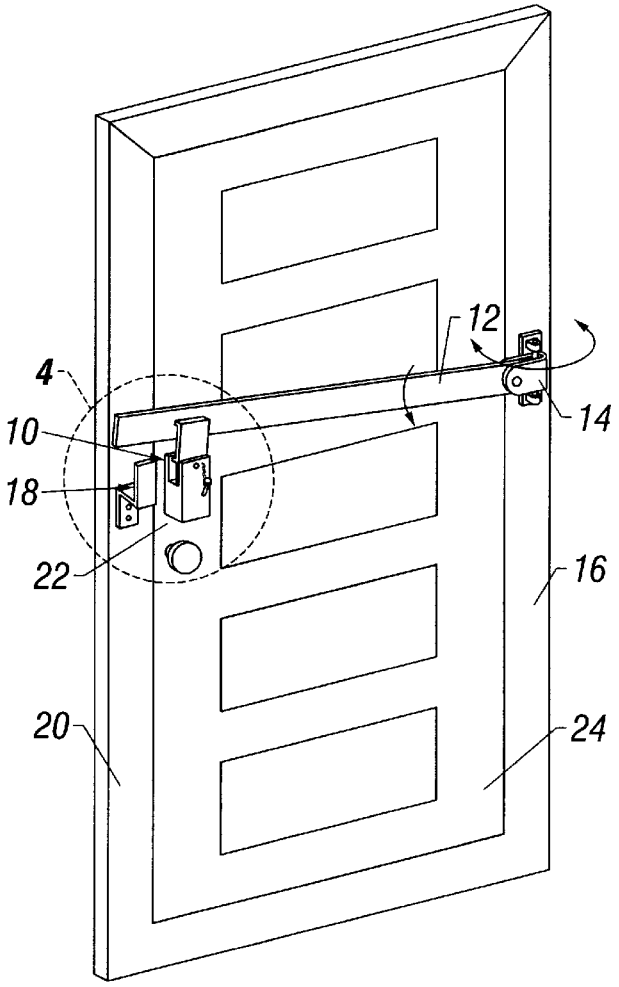
FIG. 1 Pictorially shows a first embodiment of the new security lock of the present invention using a pivoted bar between two parallel door frames, in which in the closed position the steel bar spans the distance between the door frames, and is located the entire width of the interior side of the door.
Figure 2:
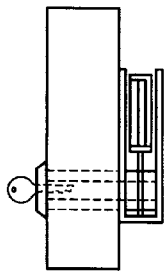
FIG. 2 shows a side elevated view of the steel bar held within the U-shaped locking mechanism.
Figure 3:
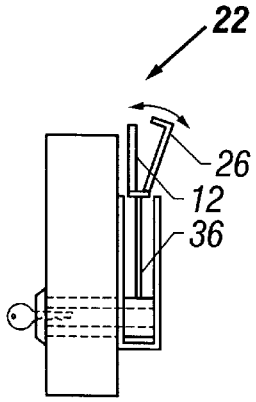
FIG. 3 shows a push bar pushing the end of the steel bar upward where the rotatable connecting member is about to rotate downward allowing the steel bar to rotate about an axis parallel to the axis of rotation of the door.
Figure 4:
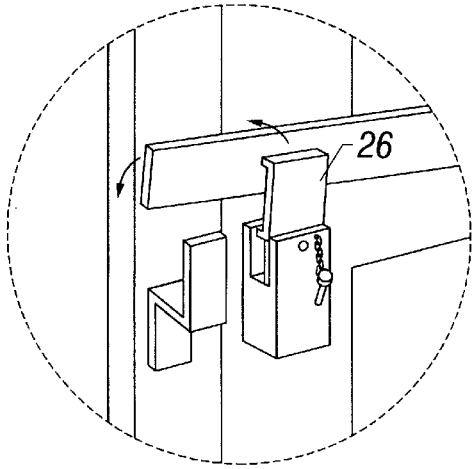
FIG. 4 is a detailed view showing the end bracket and the locking mechanism in combination with the steel bar.

FIG. 1 shows an exemplary embodiment of the new security lock of the present invention generally designated 10. Lock 10 includes a cross bar brace 12 which is pivotally and rotatably mounted at a hinge assembly 14 to one of the door frame members 16: a locking brace 18 attached to a second opposed door frame 20 and a lock mechanism 22 which is secured to a door 24. With reference to FIG. 4, locking mechanism 22 includes a pivoting bar holding mechanism 26 which, referring now to FIG. 2, pivots around cross bar brace 12 and pulls it into a housing including a U-shaped sleeve (FIG. 8*c*) when locking mechanism 22 is in the locked position. When lock mechanism 22 is unlocked, a bolt 36 forces bar 12 upward allowing pivoting bar holding mechanism 26 to pivot away from bar 12 allowing door 24 to open in the conventional manner.

Figure 5:
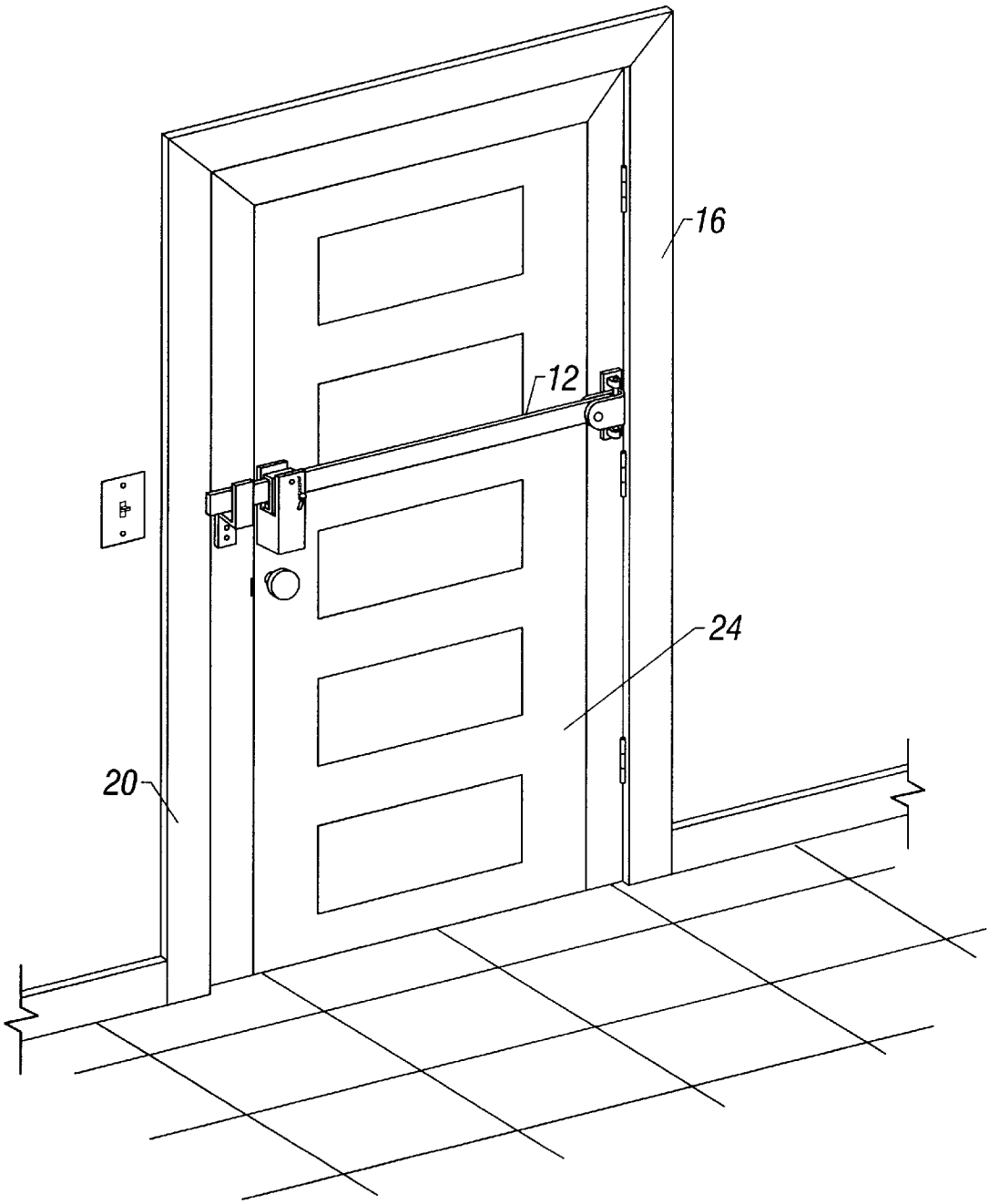
FIG. 5 is another pictorial view of the embodiment of FIG. 1 in which the steel bar is in the closed position, with FIG. 5A illustrating the rotation of the key from the exterior side of the door to either lock or unlock the door.
Figure 5A:
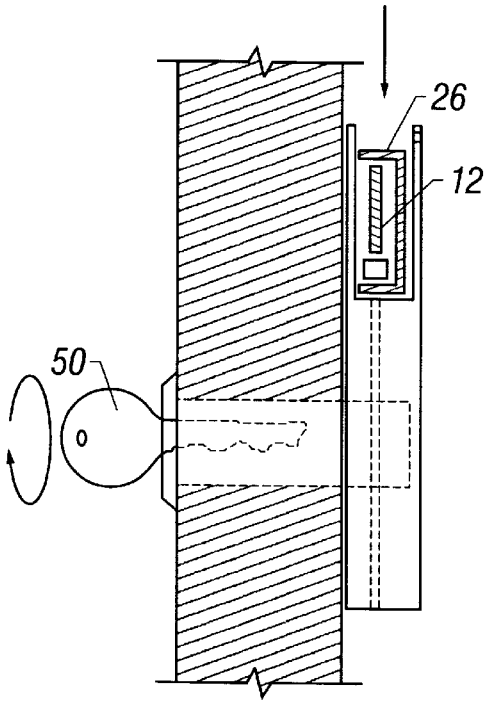

FIGS. 5 and 5A, the door 24 is illustrated as being in the closed and locked position between the pair of parallel door frames 16 and 20. FIG. 5A in particular shows the steel cross bar brace 12 being entrapped within the holding mechanism 26 which cannot be released except by turning the key 50 from the exterior side of the door 24.

Figure 6A:
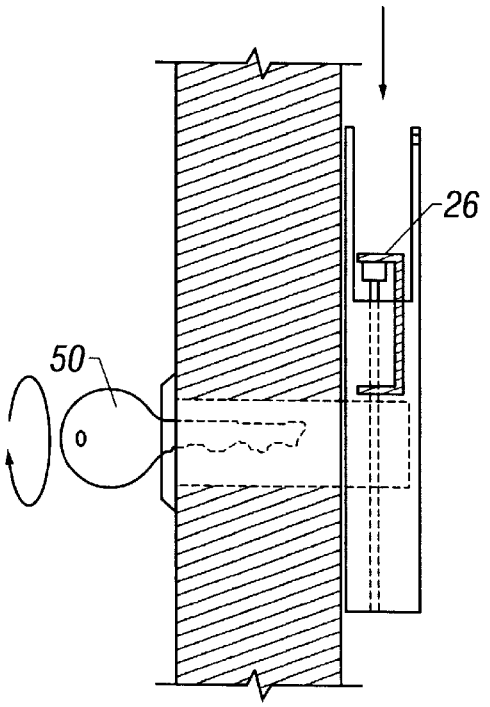
FIGS. 6 and 6A show a pictorial view of the embodiment of FIG. 5, which illustrates the key having been turned to the opened position and the steel cross bar having been disengaged and pivoted downward to a vertical position.
Figure 6:
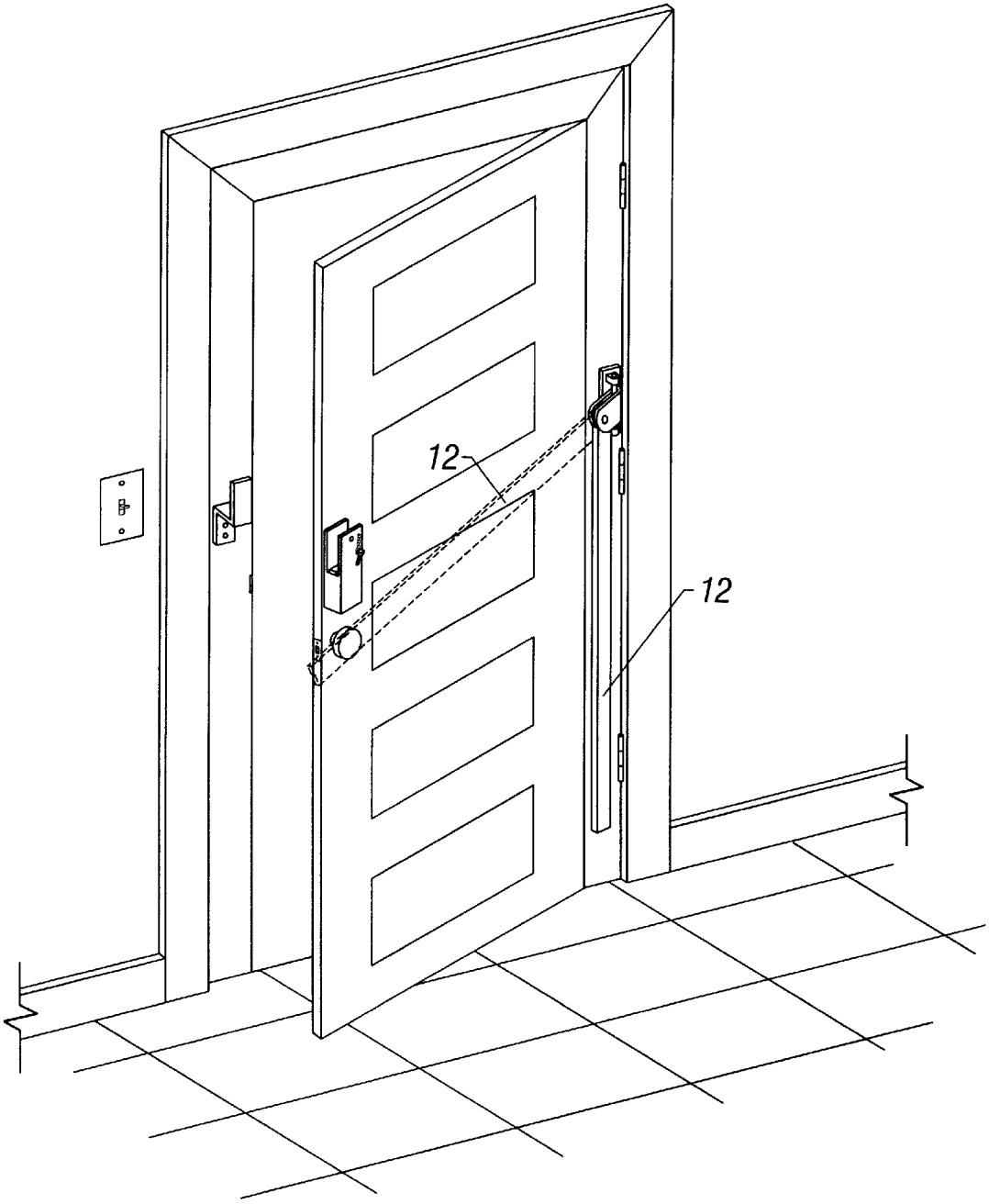

FIGS. 6 and 6A illustrate the key 50 having been turned to the opened position and the steel bar 12 having been released and pivoted down to a vertical position.

Figure 7:
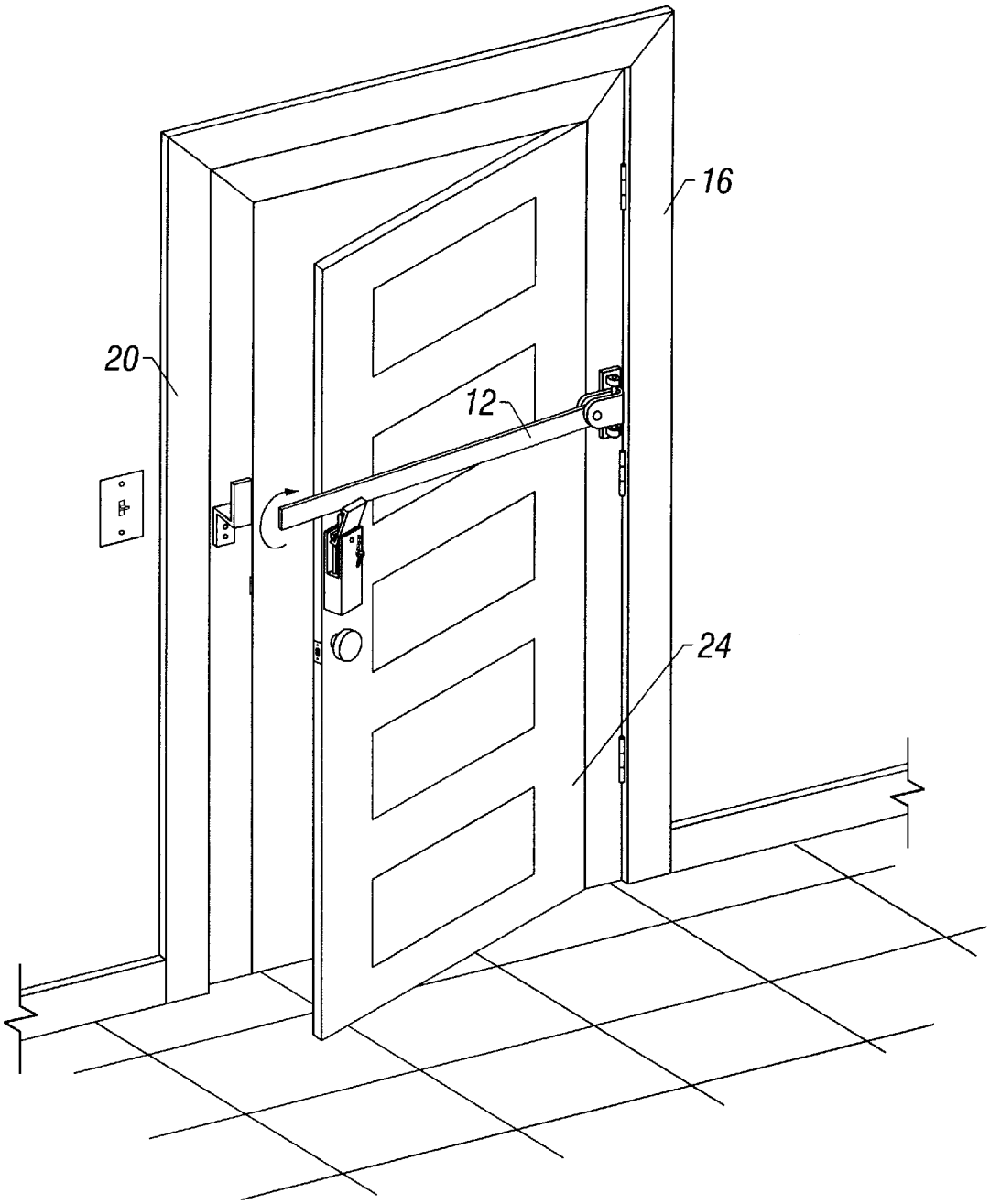
FIGS. 7 and 7A show a pictorial view of the embodiment of FIG. 5, which illustrates the key causing the steel cross bar, which is located between the parallel interior door frames, to be entrapped thereby causing the door to be locked.
Figure 7A:
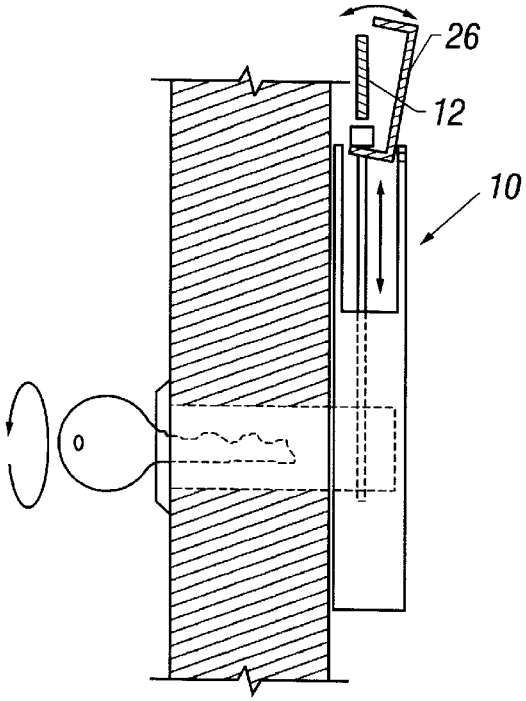

FIGS. 7 and 7A illustrate the process involved with locking the door 24 between the door frames 16 and 20 as will be illustrated in greater detail with respect to FIG. 8, the steel bar 12 is pivoted up into a position to be retained within the locking mechanism 10 and to be retained by the locking mechanism 26.

Figure 8A:
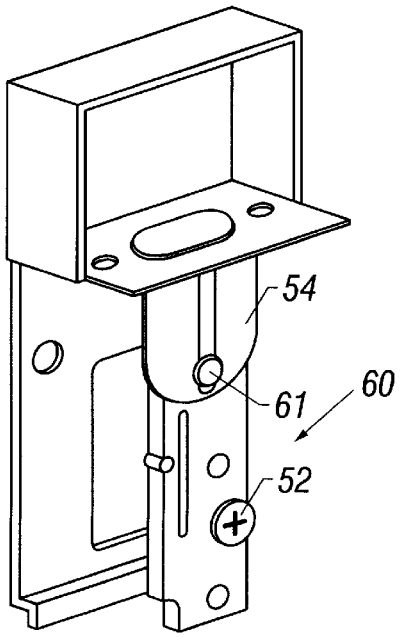
FIGS. 8A, 8B, and 8C pictorially illustrate an exploded view of an embodiment of the lock mechanism of FIG. 7 which can be used with the embodiment of FIG. 1.
Figure 8B:
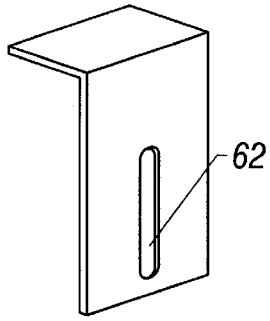
Figure 8C:
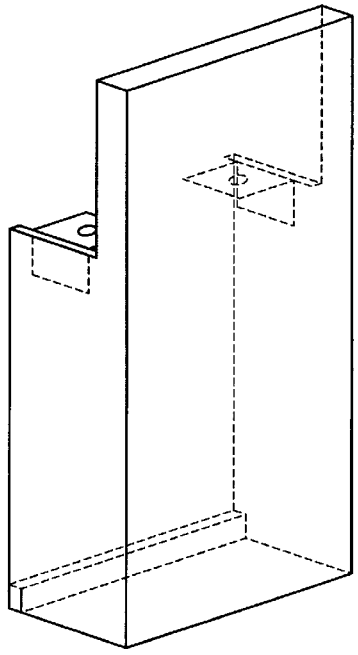
Figure 9:
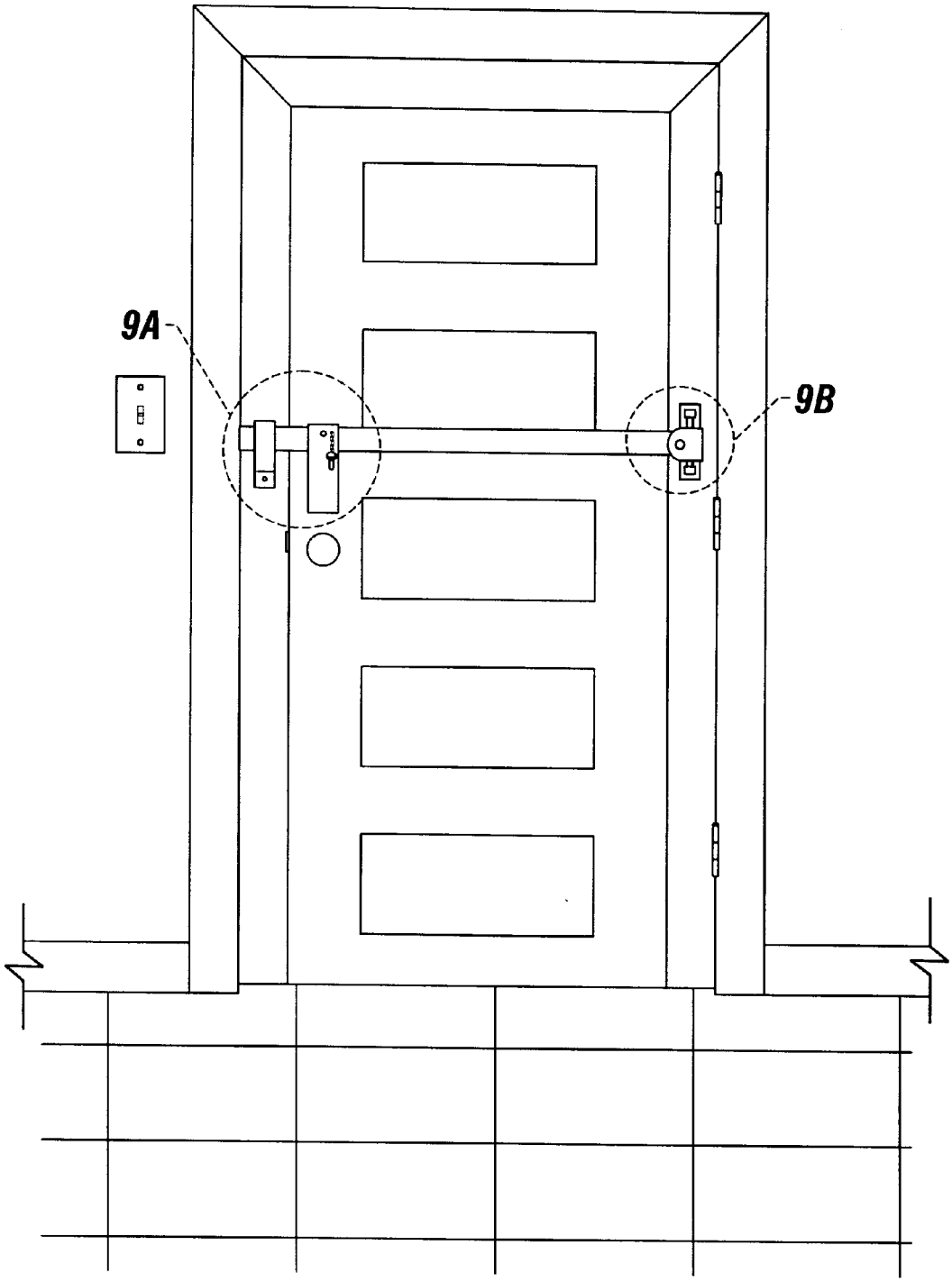
FIG. 9, pictorially shows the first embodiment of the new security lock using a pivoted bar between two parallel interior door frames, in which in the closed position the steel cross bar spans the distance between the parallel door frames and is located the entire width of the interior side of the door.
Figure 9A:
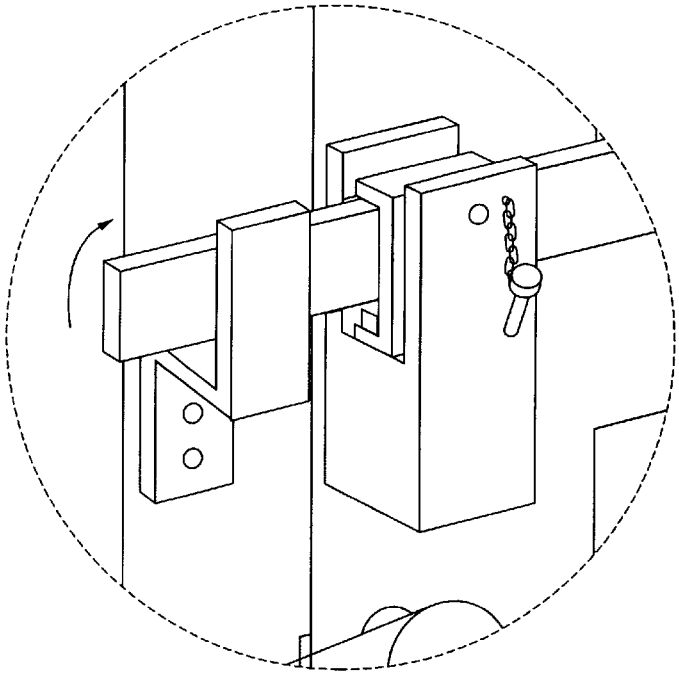
FIGS. 9A and 9B show a pictorial view of the embodiment of FIG. 5, which illustrates the key causing the steel cross bar, which is located between the parallel interior door frames, to be entrapped thereby causing the door to be locked.
Figure 9B:
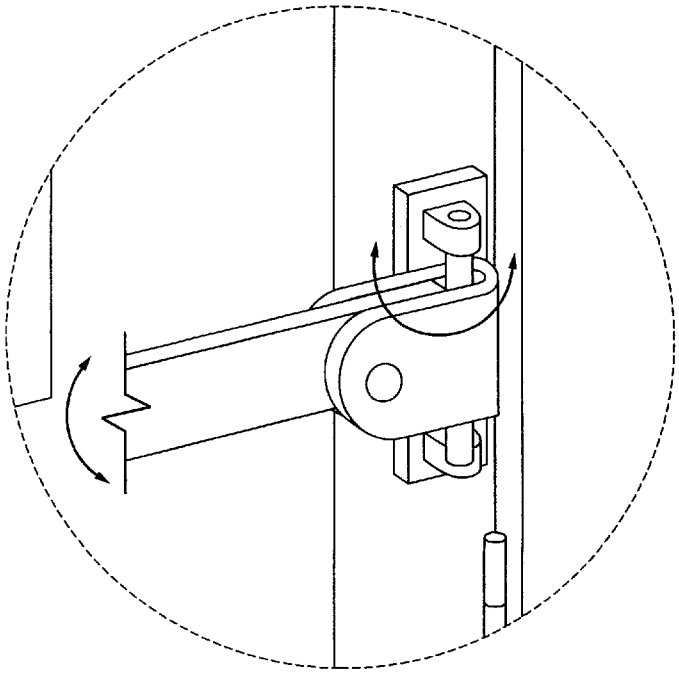

Referring now to FIGS. 8A, 8B and 8C, there is illustrated in FIG. 8A a somewhat conventional locking mechanism 60 which is operated by a key 50 which causes the mechanism 52 to rotate. As is well known in this type of locking mechanism, the rotation of the key and its operative element 52 causes the piston-like member 54 to travel up or down as the case may be. In opening the lock member illustrated in FIGS. 8A, 8B and 8C, as the key 50 is rotated in the appropriate direction, the piston member 54 pushes up against the lower side of the steel bar 12 and also allows the pin 61 to ride up in the channel 62 of the bar holding mechanism 26. This causes the bar holding mechanism 26 to uncover the steel bar 12, thus releasing the steel bar 12 from its locking mode and for the steel bar 12 to pivot down and allow the door to be opened from the outside. Those skilled in this art will recognize from the reading of the above description of the locking mechanism and a review of the drawings that biasing means, such as springs or the like as well as cammed surfaces can be used to aid in the release of the steel bar 12 once the locking mechanism has been raised to the open position by the operation of the key 50.

Figure 10:
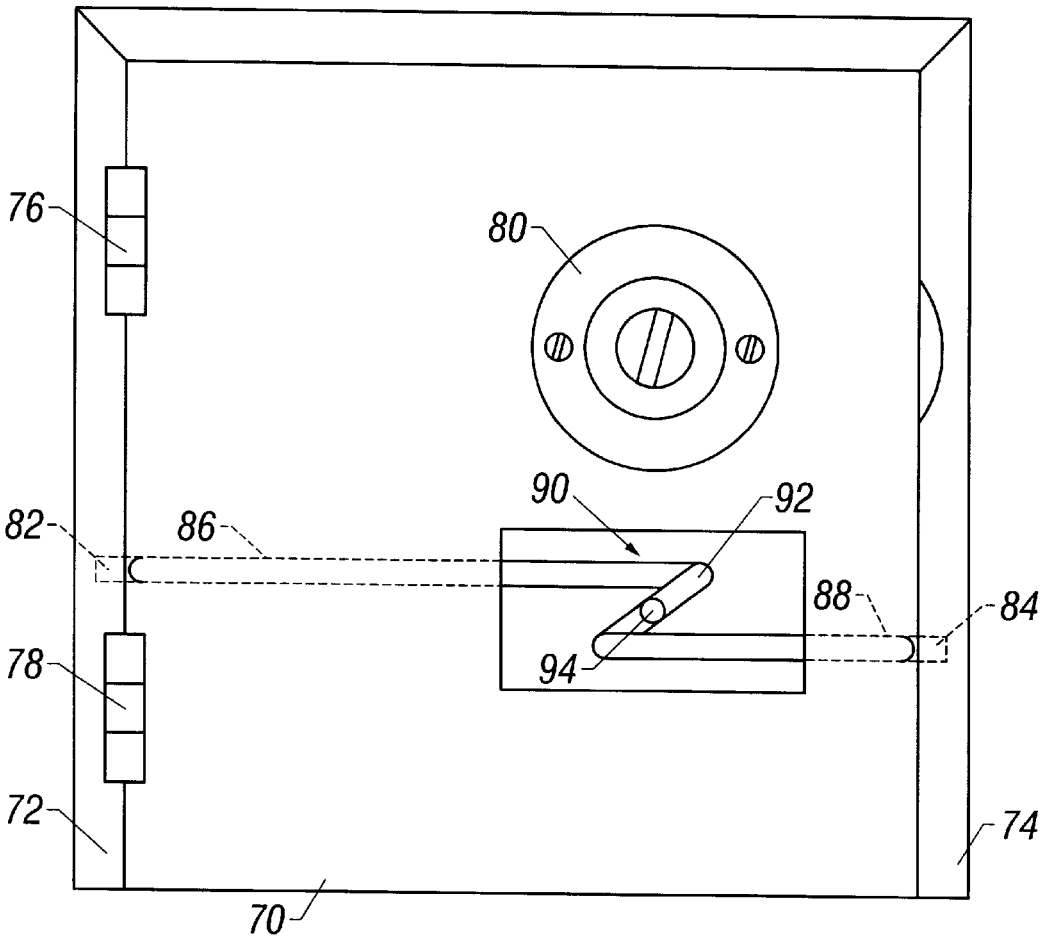
FIGS. 10 and 11 illustrate an alternative embodiment of the present invention, in two operative positions, respectively, in which the steel bar has a centralized, rotatable mechanism, operable from a key used in the outside face of the door, which either lengthens or shortens a steel bar having its two remote ends adapted for being inserted or removed from receptacles located, respectively, in a pair of door frames in which the door is situated.
Figure 11:
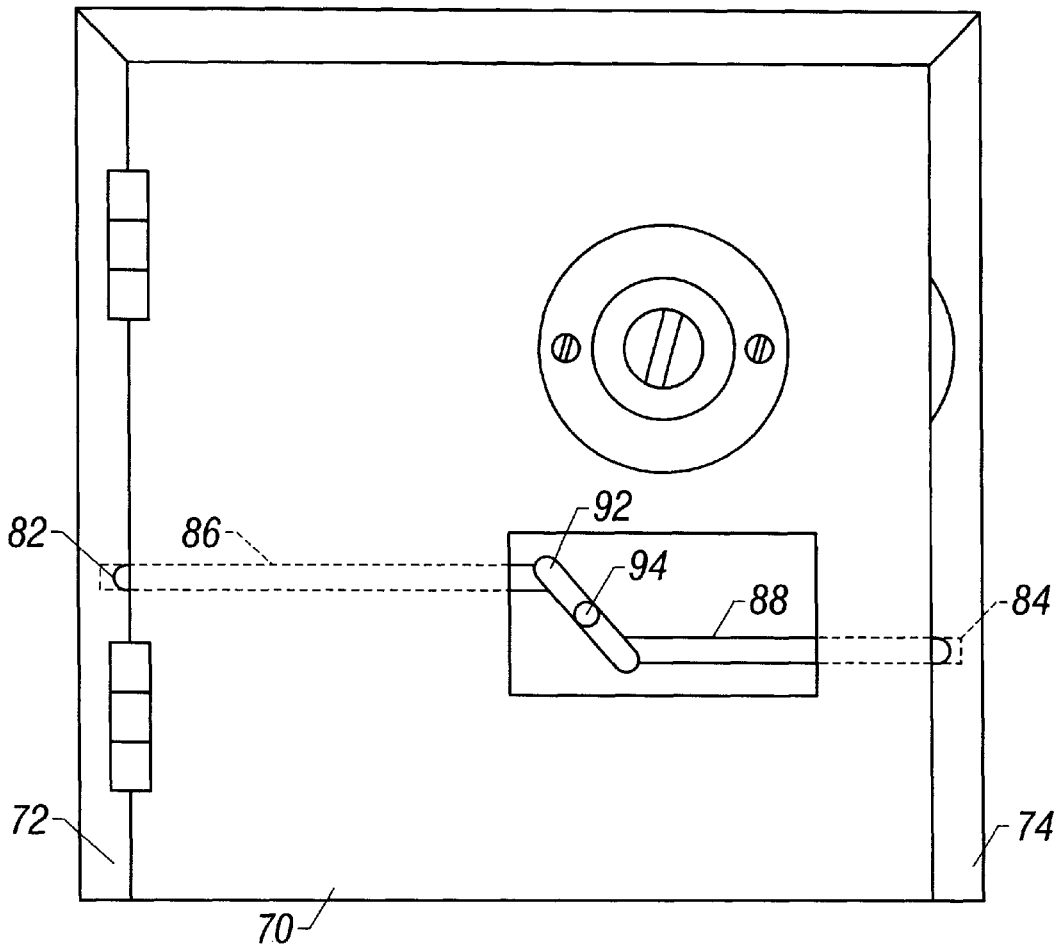

Referring now to FIGS. 10 and 11, there is illustrated an alternative embodiment of the present invention in which a door 70 is situated between a pair of parallel door frames 72 and 74 and which is supported within the frames 72 and 74 by a pair of hinges 76 and 78. A conventional locking mechanism 80 is optional for use with the embodiment illustrated in FIG. 10 and which can be locked or unlocked from the inside of the door 70 and can be locked or unlocked with a key from the outside of the door 70.

The door frame 72 has a locking receptacle 82 and the door frame 74 has a locking receptacle 84. The receptacles 82 and 84 are preferably circular in the cross section and sized to receive the steel bar 86 and the steel bar 88, respectively, when the door 70 is in its locked position. The steel bars 86 and 88 can be considered as a single bar which can be lengthened or shortened by manipulating the mechanism 90 located between the extreme ends of the bars 86 and 88 in the opened position, as illustrated in FIG. 10, the bars 86 and 88, in conjunction with a pivot arm 92 form a Z-shaped member which pivot around a pivot point 94 which closes the arms 86 and 88 to rotate around the pivot point 94 whenever the key is turned on the outside of the door 70.

It should be appreciated that the mechanism 90 is illustrated as being within a cutout portion of the door 70 which can be covered with a metal plate (not illustrated) during the manufacturing of the door, or whenever a door is being retrofitted to use the mechanism 90 illustrated in FIG. 10. It should be appreciated further that the door 70 can be all metal, or can be solid wood, or the like. As an alternative mode of manufacture, the mechanism 90 can be installed during the manufacturing process for making the door 70 instead of using the cutout as illustrated in FIG. 10.

The bars 86 and 88, as well as the pivot arm 92 can be manufactured from any appropriate material, such as steel or other metal, or from hard plastic or the like such as nylon or dacron or the like. Moreover, the tunnels through which the arm segments 86 and 88 move can be co-axial if desired. Suffice it to say at this point that using this manufacturing process, the mechanism illustrated in FIG. 10 cannot be easily be defeated by a thief or burglar because all of the moving parts are underneath whatever material is used to manufacture the door, the door frames, and the cover plate , if one is used, to cover the mechanism 90. If the door frames are made from wood, it would be advantageous to use metal inserts around the receptacles 82 and 84 to make them more difficult to defeat.

Referring now to FIG. 11, the locking mechanism is illustrated as being in the closed position, as determined by the rotation by the key on the other side of the door 70 which causes the lever arm 92 to rotate around the axis of rotation 94. By such rotation, the arm 86 extends into the receptacle 82 and the arm 88 extends into the receptacle 84, thus completely locking the door 70, a status which cannot be varied by anyone inside the residence. The only way for unlocking the door is to use the key on the outside of the door 70.

Thus there has been illustrated herein a pair of embodiments of the invention, each of which is locked by using a key on the outside surface of a door, but which cannot be unlocked from within the interior of the residence, office, or whatever else type structure is being protected. These two embodiments of the invention are very helpful in defeated a burglar or robber from using whichever door the locking mechanism is located on because once it is realized by a thief or a burglar that the particular door cannot be used to transport the large items of the house or the office, such as computers, televisions, VCR's and the like, the burglars are most likely to leave the premises without having been successful in removing items from the structure.

What is claimed is:

1. A new and improved security lock for a door situated within first and second parallel door frames, each of said door frames having first and second sides, comprising:

a door having a given width and having first and second sides, and having a key-actuated lock useable from said first side of the door;

a cross-bar brace having a length in excess of the width of said door, wherein the first end of brace is pivotally connected to the first side of the first door frame, and the second end of the brace being latchable with a brace mounted vertically on the first side of said second door frame;

a locking mechanism integrally positioned relative to the lock comprising a housing mounted to the second side of the door and a holder for removably entrapping the brace, whereby the rotation of the key-actuated lock vertically maneuvers the holder relative to the housing;

the housing further comprises an integral U-shaped sleeve for receiving the holder and brace;

whereby the holder includes a top flange for receiving the brace thereunder, whereby the flange inhibits the vertical motion of the brace; and whereby the rotation of the key-actuated lock in a first direction causes the holder and brace to be latched within the sleeve, and the rotation of said key-actuated lock in a second direction causes said holder and brace to be unlatched from the sleeve.

* * * * *